US009511913B2

(12) United States Patent
Brooks et al.

(10) Patent No.: US 9,511,913 B2
(45) Date of Patent: Dec. 6, 2016

(54) PHARMACEUTICAL WASTE CONTAINER AND LID

(71) Applicants: Christopher R. Brooks, Austin, TX (US); Jamie Hoff, San Diego, CA (US)

(72) Inventors: Christopher R. Brooks, Austin, TX (US); Jamie Hoff, San Diego, CA (US)

( * ) Notice: Subject to any disclaimer, the term of this patent is extended or adjusted under 35 U.S.C. 154(b) by 17 days.

(21) Appl. No.: 14/475,413

(22) Filed: Sep. 2, 2014

(65) Prior Publication Data

US 2015/0060449 A1 Mar. 5, 2015

Related U.S. Application Data

(60) Provisional application No. 61/873,286, filed on Sep. 3, 2013.

(51) Int. Cl.

| | |
|---|---|
| ***B65D 51/18*** | (2006.01) |
| ***B65D 55/10*** | (2006.01) |
| ***B65D 25/02*** | (2006.01) |
| ***B65D 43/02*** | (2006.01) |
| ***B65F 1/10*** | (2006.01) |
| ***B65F 1/14*** | (2006.01) |
| *B65F 1/06* | (2006.01) |

(52) U.S. Cl.

CPC ..... *B65D 55/10* (2013.01); *B65D 25/02* (2013.01); *B65D 43/02* (2013.01); *B65F 1/10* (2013.01); *B65F 1/1607* (2013.01); *B65F 1/1615* (2013.01); *B65F 1/06* (2013.01); *B65F 2210/1446* (2013.01); *B65F 2220/128* (2013.01); *Y10T 29/49826* (2015.01)

(58) Field of Classification Search

CPC ..... B65D 55/10; B65D 25/02; B65D 43/08; A61B 19/0288; A61B 19/0287; A61B 19/029; A61B 2019/0202; A61B 2019/0209; A61B 2019/0213; B61F 1/10; B61F 1/1607; A61J 1/03

See application file for complete search history.

(56) References Cited

U.S. PATENT DOCUMENTS

| | | | | | |
|---|---|---|---|---|---|
| 1,333,051 | A * | 3/1920 | Young | B65F 1/10 | 220/252 |
| 3,300,083 | A * | 1/1967 | Wright | B65F 1/08 | 141/95 |
| 3,651,817 | A * | 3/1972 | Baker | A24F 19/14 | 131/237 |
| 4,964,425 | A * | 10/1990 | Chang | A24F 19/14 | 131/237 |
| 5,046,614 | A * | 9/1991 | Torres | A61B 2050/052 | 206/366 |

(Continued)

*Primary Examiner* — Anthony Stashick
*Assistant Examiner* — James Way
(74) *Attorney, Agent, or Firm* — Pierson IP, PLLC

(57) ABSTRACT

Embodiments disclosed herein describe systems and methods for a reusable pharmaceutical waste container with a restrictive lid. In embodiments, as the amount of pharmaceutical waste increases to a pharmaceutical waste threshold, the pharmaceutical waste may interact with a flywheel to vertically move the axis of rotation of the flywheel from a first position to a second position. Responsive to the axis of rotation of the flywheel being vertically changed to the second position, a first of a plurality of fans of the flywheel may lock the restrictive lid, such that the restrictive lid may not open internally within the restrictive lid so no additional waste may be placed on any of the plurality of fans.

19 Claims, 10 Drawing Sheets

(56) References Cited

U.S. PATENT DOCUMENTS

| | | | | | |
|---|---|---|---|---|---|
| 5,387,735 | A * | 2/1995 | Ponsi | A61B 19/0288 | 206/366 |
| 5,560,512 | A * | 10/1996 | Hahn | B65F 1/10 | 206/366 |
| 5,570,783 | A * | 11/1996 | Thorne | A61B 19/0288 | 206/366 |
| 6,685,017 | B2 * | 2/2004 | Erickson | A61M 5/3205 | 206/366 |
| 6,923,318 | B1 * | 8/2005 | Erickson | A61B 19/04 | 206/366 |
| 7,556,149 | B2 * | 7/2009 | Erickson | A61M 5/3205 | 206/365 |
| 7,694,822 | B2 * | 4/2010 | Sullivan | A61B 17/3217 | 206/366 |
| 2003/0168367 | A1 * | 9/2003 | Pike | A61B 19/0288 | 206/366 |
| 2008/0217447 | A1 * | 9/2008 | Jeansonne | B02C 19/0075 | 241/100 |
| 2009/0039183 | A1 * | 2/2009 | Wakeman | B02C 19/0075 | 241/2 |
| 2009/0114667 | A1 * | 5/2009 | Sansoucy | A61B 19/0262 | 221/34 |
| 2009/0294312 | A1 * | 12/2009 | Hitson | A61B 19/0287 | 206/364 |
| 2010/0155400 | A1 * | 6/2010 | Finnestad | A61B 19/0288 | 220/200 |
| 2010/0243495 | A1 * | 9/2010 | Segal | A61B 19/0256 | 206/366 |
| 2011/0303666 | A1 * | 12/2011 | Kunik | A61B 19/026 | 220/200 |
| 2013/0048660 | A1 * | 2/2013 | Goldstein | A61B 19/0287 | 220/810 |

* cited by examiner

PHARMACEUTICAL WASTE CONTAINER AND LID

CROSS-REFERENCE TO RELATED APPLICATIONS

This application claims a benefit of priority under 35 U.S.C. §119 to Provisional Application No. 61/873,286 filed on Sep. 3, 2013, which is fully incorporated herein by reference in its entirety.

BACKGROUND INFORMATION

Field of the Disclosure

Examples of the present disclosure are related to a pharmaceutical waste container and lid. More particularly, embodiments relate to a reusable pharmaceutical waste container, restrictive lid, and flywheel, wherein the restrictive lid and flywheel restrict, limit, and/or inhibit needles/sharps from being disposed in the pharmaceutical waste container.

Background

Pharmaceutical waste is waste produced from healthcare premises or personnel, such as hospitals, clinics, doctors, nurses, offices, veterinary hospitals, labs, etc. For example, pharmaceutical waste may include pills, patches, ampules vials, sharps, etc. Disposal of pharmaceutical waste is an environmental concern due to the increased findings of drugs and pharmaceuticals in our nation's drinking water, and for other reasons.

Currently, pharmaceutical waste is disposed in conventional pharmaceutical waste containers that are centrally located in secure areas in healthcare premises that only pharmaceutical practitioners and staff may access.

However, the pharmaceutical practitioners may be required to spend time and effort transporting the pharmaceutical waste to the centrally located conventional pharmaceutical waste containers. Situations may arise where due to sanitization hazards and concerns, the pharmaceutical practitioners may not be able to transport the pharmaceutical waste to the pharmaceutical waste containers located in a secure area.

Conventional waste containers may also be reusable pharmaceutical waste containers. The reusable pharmaceutical waste containers are required to be collected by a third party vendor at the healthcare premise, brought to a sanitization facility, and returned to the healthcare premise to receive pharmaceutical waste. However, reusable pharmaceutical waste containers require the waste container to be collected by the third party vendor and sanitized at a remote location. This process is neither time nor finance efficient.

Additionally, the current reusable pharmaceutical waste containers are actually sharps (needles) waste containers but are made to be a different color. Because these containers look like sharps containers and the lid opening allow sharps to be placed in them, pharmaceutical practitioners will inevitably dispose needles into these reusable pharmaceutical containers. This process has negative impacts from both a regulatory and finance standpoint.

Accordingly, needs exists for more efficient and effective pharmaceutical waste containers.

SUMMARY

Embodiments disclosed herein describe systems and methods for a reusable pharmaceutical waste container with a restrictive entry lid. The reusable pharmaceutical waste container with the restrictive entry lid may include a bracket, wherein the bracket is configured to be mounted on a movable work station, a wall, or any other apparatus within the pharmaceutical premise.

In embodiments, the pharmaceutical waste container may be configured to be lined with a removable bag liner. The removable bag liner may be disposed within the reusable pharmaceutical waste container, receive pharmaceutical waste, and be removed from the reusable pharmaceutical waste container. Once a first removable bag liner is removed from the reusable pharmaceutical waste container, a second removable bag liner may be replaced within the pharmaceutical waste container. Therefore, the reusable pharmaceutical waste container may maintain a sanitized state while being disposed within any location within the pharmaceutical health premise.

In embodiments, the restrictive lid may be configured to cover the pharmaceutical waste container. The restrictive lid may include a restrictive door, flap, or gate (referred to collectively and independently herein after as "restrictive door"), slots, flywheel, at least one internal stop, a pill drop slot, and a vertical narrow slot for patches The restrictive door may be configured to open and close, and receive pharmaceutical waste. The restrictive door may be coupled to the restrictive lid, such that the restrictive lid may rotate, slide, or swing from a first position being flush with a surface of the restrictive lid to a second position forming an opening in the restrictive lid. In embodiments, the restrictive door may have a height and width configured to limit, reduce, and/or filter pharmaceutical waste from being placed within the restrictive door. For example, in one embodiment, the restrictive door may have a height and/or width that are smaller than most needles, such that needles may not be inserted through the restrictive door.

The slots on the restrictive lid may be may be configured to receive projections disposed on the sides of the flywheel, and they may be positioned on opposite sides of the restrictive lid. Responsive to the projections of the flywheel being disposed within the slots, the slots may control the axis of rotation of the flywheel. If the projections of the flywheel are disposed within the slots, the axis of rotation of the flywheel may be vertically moved based on the height of the slots and the amount of pharmaceutical waste disposed within the reusable pharmaceutical waste container.

The flywheel may be configured to be secured within the restrictive lid via projections positioned on the sides of the flywheel and the slots positioned on the sides of the restrictive lid. The flywheel may include a plurality of fans projecting away from the center of the flywheel. In embodiments, the restrictive door may be configured to open internally within the restrictive lid moving a first of the plurality of fans. Pharmaceutical waste may be configured to be positioned on a second of the plurality of fans, then rotational force and/or gravity may rotate the flywheel, and the second of the plurality of fans may dispose the pharmaceutical waste within the reusable pharmaceutical waste container.

In embodiments, the plurality of fans may have a depth that is configured to limit, restrict, and/or filter the type of pharmaceutical waste that is disposed within the reusable pharmaceutical waste container. For example, in one embodiment, the depth of fans may be smaller than the length of most needles, such that needles may not be placed on one of the fans.

In embodiments, as the amount of pharmaceutical waste within the reusable pharmaceutical waste container increases past a pharmaceutical waste threshold, the pharmaceutical waste may interact with the flywheel to vertically move the axis of rotation of the flywheel from a first position to a second position. Responsive to the axis of rotation of the flywheel being vertically changed to the second position, a first of the plurality of fans may interface with the restrictive door to lock the restrictive door. By locking the restrictive door, the restrictive door may not open internally within the restrictive lid so no additional waste may be placed on any of the plurality of fans.

At least one internal stop may be positioned within an inner surface of the restrictive lid. The internal stops may be projections within the inner surface of the restrictive lid that is configured to limit, reduce, and/or stop the flywheel from rotating. In embodiments, the internal stops may be configured to interface with at least one of the plurality of fans when the axis of rotation of the flywheel is in the second position to stop the rotation of the flywheel.

In one embodiment, if the axis of rotation of the flywheel is in the second position, an end of the first of the plurality of fans may be positioned adjacent to a first internal stop, such that the flywheel may not be rotated in a first rotational direction. In one embodiment, if the vertical axis is in the second position, an end of a second of the plurality of fans may be positioned adjacent to a second internal stop, such that the flywheel may not be rotated in a second rotational direction, wherein the first and second rotational directions are different rotational directions.

In one embodiment, the pill drop slot and vertical narrow slot for patches may be positioned on a first side of the restrictive lid. Furthermore, the projections disposed on the sides of the flywheel may have different lengths, wherein the projection disposed on the first side of the restrictive lid may be longer than the projection disposed on the second side of the restrictive lid. The lengths of the projections may position the flywheel adjacent to the second side of the restrictive lid, but offset from the first side of the restrictive lid. Accordingly, pills and other items may be disposed of through the pill drop slot and/or the vertical narrow slot when the flywheel is in the first and/or second position.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
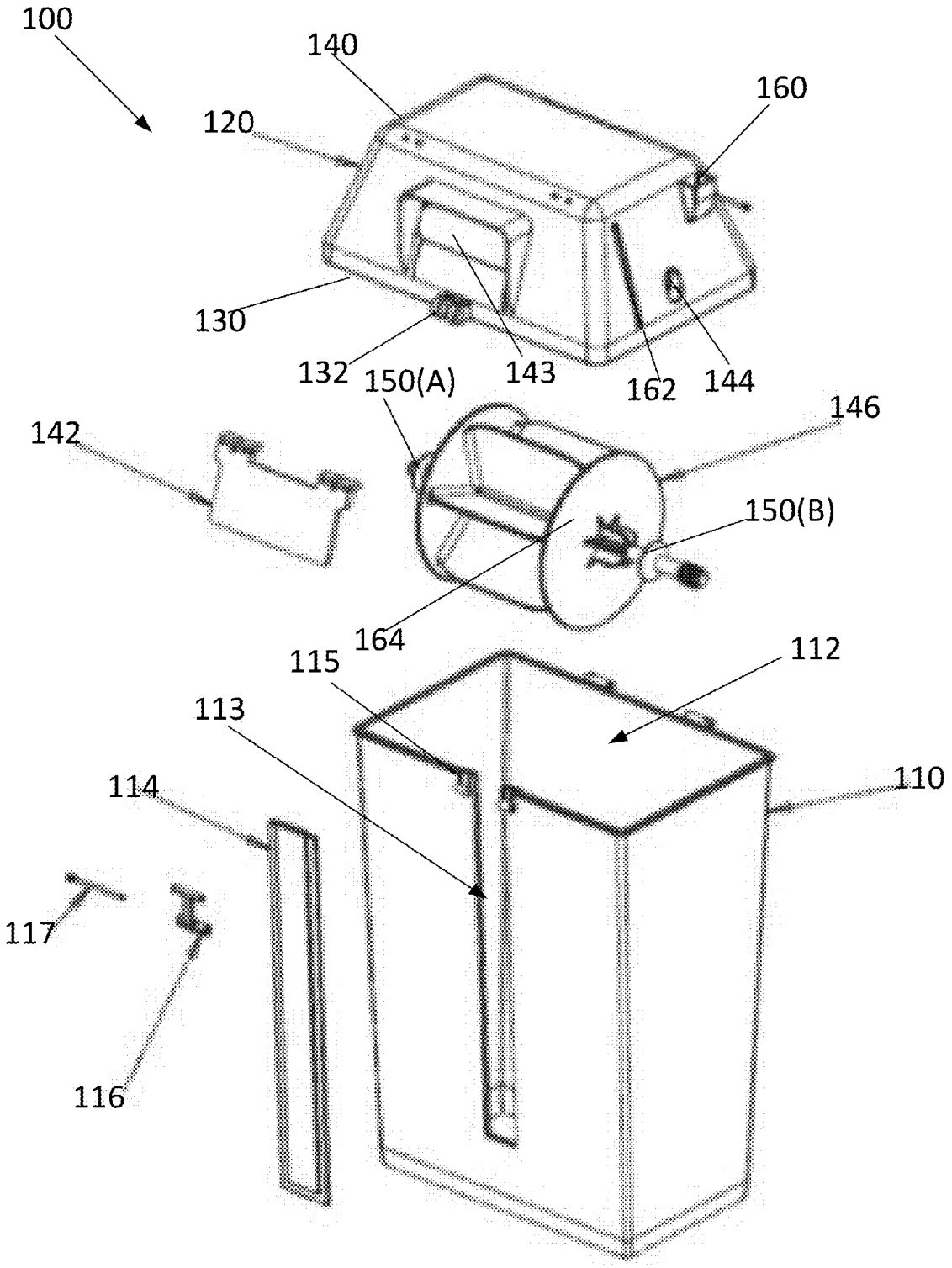
FIG. 1 depicts an exploded view of a pharmaceutical waste system, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Additionally, any examples or illustrations given herein are not to be regarded in any way as restrictions on, limits to, or express definitions of any term or terms with which they are utilized. Instead, these examples or illustrations are to be regarded as being described with respect to one particular embodiment and as being illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such nonlimiting examples and illustrations includes, but is not limited to: "for example," "for instance," "e.g.," and "in one embodiment."

FIG. 1 depicts an exploded view of a pharmaceutical waste system 100, according to one embodiment. Pharmaceutical waste system 100 may be configured to hold and store pharmaceutical waste used in a pharmaceutical premise facility and/or generated by a pharmaceutical practitioner. Pharmaceutical waste system 100 may include a reusable pharmaceutical waste container 110 and a restrictive entry lid 120.

Reusable pharmaceutical waste container 110 may be any container, vessel, receptacle, etc. configured to container, store, and/or transport pharmaceutical waste. Reusable pharmaceutical waste container 110 may include a hollow inner surface with an opening 112, transparent window interface 113, transparent window 114, locking interface 115, locking latch 116, and locking pin 117.

Opening 112 may be positioned at an upper surface of reusable pharmaceutical waste container 110. Pharmaceutical waste may be inserted into reusable waste container through opening 112.

Reusable pharmaceutical waste container 110 may be configured to be lined with a removable bag liner, which may be disposed within the inner surface of reusable pharmaceutical waste container 110. In embodiments, a first bag liner may be disposed within reusable pharmaceutical waste container 110, pharmaceutical waste may be disposed within reusable pharmaceutical waste container 110, the first bag liner may be removed from reusable pharmaceutical waste container 110, and a second bag liner may be disposed within pharmaceutical waste container 110.

In embodiments, the bag liners may be coupled to the inner surface of reusable pharmaceutical waste container 110, over opening 112 positioned at the upper surface of reusable pharmaceutical waste container 110, or at any other position within pharmaceutical waste system 100.

Transparent window interface 113 may be positioned on a first face of waste container 110. Transparent window interface 113 may be an orifice extending from a top surface of pharmaceutical waste container 110 towards a bottom surface of pharmaceutical waste container 110. Transparent window interface 113 may be configured to receive transparent window 114, wherein transparent window 114 allows a user to look into opening 112 of pharmaceutical waste container 110.

Locking interface 115 may be a locking device positioned on an upper surface of pharmaceutical waste container 110. Locking interface 115 may include downward facing projection configured to interface with locking latch 116, and orifices configured to receive locking pin 117. In embodiments, the locking pin 117 may be configured to be inserted through orifices positioned on locking interface 115 and orifices positioned on a first end of lock latch 116. In embodiments, the orifices positioned on locking interface 115 and the first end of lock latch 116 may be configured to be aligned with one another.

Restrictive lid 120 may be configured to cover reusable pharmaceutical waste container 110 and opening 112. Restrictive lid 120 may include a perimeter 130 and an upper portion 140, which may be coupled together via the hinges and locking pin receiver 132.

Perimeter 130 of restrictive lid 120 may have a circumference that is larger than the circumference of reusable pharmaceutical waste container 110 and/or opening 112, such that perimeter 130 of restrictive lid 120 may be placed over reusable pharmaceutical waste container 110 over opening 112 to couple pharmaceutical waste container 110 and restrictive lid 120. In embodiments, perimeter 130 of restrictive lid 120 may be configured such that if perimeter 130 is placed around pharmaceutical waste container 110, perimeter 130 of restrictive lid 120 may snap to reusable pharmaceutical waste container 110 to secure restrictive lid 120. Perimeter 130 of restrictive lid 120 may also be configured to be decoupled from reusable pharmaceutical waste container 110.

Perimeter 130 of restrictive lid 120 may include hinges (not shown) and lock receiver 132 configured to couple upper portion 140 of restrictive lid 120 and perimeter 130 of restrictive lid 120. In embodiments, hinges may be configured to allow upper portion 140 of restrictive lid 120 to rotate away from perimeter 130 of restrictive lid and the opening 112 of reusable pharmaceutical waste container 110. Lock receiver 132 may be configured to be positioned above the first end of locking latch 116 when locking pin 117 is inserted through the locking interface 115. Furthermore, lock receiver may be configured to be positioned below a second end of locking latch 116 when locking pin is inserted through locking interface 115. The orifices of lock receiver 132 may be configured to receive a lock, such that locking latch 166 may be secured between the lock and restrictive lid 120.

Upper portion 140 of restrictive lid 120 may be configured to cover opening 112 of reusable pharmaceutical waste container 110. Upper portion 140 of restrictive lid 120 may include a restrictive door 142, slot 144, a flywheel 146, pill drop interface 160, vertical slot 162, and at least one internal stop (not shown).

Restrictive door 142 may be configured to open and close, and may be configured to cover an opening 143 within upper portion 140 of restrictive lid 120 and opening 112. Restrictive door 142 may be coupled to upper portion 140 of restrictive lid 120 along an upper edge of restrictive door 142. If restrictive door 142 is in the opened position, then pharmaceutical waste may be inserted into opening 143, and if restrictive door 142 is in the closed position, then pharmaceutical waste may not be inserted into opening 143. In embodiments, if restrictive door 142 is in the closed position, then the edges of restrictive door 142 may be adjacent to the edges of an opening 143. In embodiments, restrictive door 142 may have a height and width configured to limit, reduce, and/or filter the type of waste that may be placed within the opening 112 within upper portion 140 of restrictive lid responsive to restrictive door 142 being positioned in the open position. For example, in one embodiment, restrictive door 142 may have a height and/or width that is smaller than a sharp, such that sharps may not be disposed be inserted through restrictive door 142.

Restrictive door 142 may be configured to rotate, swing, or slide from the closed position to the opened position, wherein at least portions of restrictive door 142 are internally positioned within upper portion 140 of restrictive lid 120. Responsive to restrictive door 142 being in the open position, the opening 112 within upper portion 140 of restrictive lid 120 may be utilized to place pharmaceutical waste within upper portion 140 of restrictive lid 120. In embodiments, restrictive door 142 may be a spring loaded door, wherein force is required to open restrictive door 142, and if force is not applied to restrictive door 142 a spring may maintain restrictive door 142 in the closed position.

Slots 144 may be configured to be positioned on opposite sides of upper portion 140 of restrictive lid 120 and/or the sides of upper portion 140 of restrictive lid 120 that are adjacent to restrictive door 142.

Slots 144 may be configured to receive projections 150 disposed on the sides of flywheel 146, and secure flywheel 146 to upper portion 140 of restrictive lid 120. Responsive to the projections 150 being disposed within slots 144, slots 144 may control the vertical position of the axis of rotation of flywheel 146.

Flywheel 146 may be a device that is configured to couple with slots 144, and rotate within upper portion 140 of restrictive lid 120 and reusable pharmaceutical waste container 110. Flywheel 146 may have a plurality of projections configured to be inserted within slots 144. Responsive to the vertical positioning of the projections within slots 144, the axis of rotation of flywheel 146 may be changed within upper portion 140 of restrictive lid and reusable pharmaceutical waste container 110.

In embodiments, flywheel 146 may include a plurality of fans projecting away from the center of the flywheel. The plurality of fans may be configured to receive pharmaceutical waste via restrictive door 142, if restrictive door 142 is in the open position. The plurality of fans may have a depth that is configured to limit, restrict, and/or filter the type of pharmaceutical waste that is disposed within the reusable pharmaceutical waste container. For example, in one embodiment, the depth of fans may be smaller than the length of a sharp, such that sharps may not be placed on one of the fans. If pharmaceutical waste is placed on a first of the plurality of fans, flywheel 146 may rotate such that the pharmaceutical waste may be deposited within reusable pharmaceutical waste container 110. If pharmaceutical waste is deposited within reusable pharmaceutical waste container 110, the pharmaceutical waste within the reusable pharmaceutical waste container 110 may touch at least one of the plurality of fans and vertically move the projections within slots 144 from a lower, first position to a upper, second position. In embodiments, as the amount of pharmaceutical waste within reusable pharmaceutical waste container 110 increases to a pharmaceutical waste threshold, the pharmaceutical waste may interact with the flywheel to vertically move the axis of rotation of the flywheel from the lower, first position to the upper, second position. Responsive to the axis of rotation of the flywheel 146 being vertically changed to the upper, second position, an end of first of the plurality of fans may be positioned adjacent to restrictive lid 142, such that restrictive lid 142 may not internally open within upper portion 140 of restrictive lid 120 and no additional waste may be placed on any of the plurality of fans.

Upper portion 140 of restrictive lid 120 may also include a pill drop interface 160 and vertical orifice 162. Pill drop interface 160 and vertical orifice 162 may be positioned on a first side of restrictive lid 120, wherein pill drop interface 160 may be configured to receive pills, and vertical orifice 162 may be configured to receive patches. In embodiments, the projections 150(A) and 150(B) may have different lengths, wherein the projection 150(B) extending towards the first side of restrictive lid 120 may be longer than the projection 150(A) extending towards the second side of restrictive lid 120. Accordingly, there may be a distance between a face 164 of flywheel 146 and the first side of restrictive lid 120. Therefore, objects may be interested through pill drop interface 160 and/or vertical orifice 162 even if flywheel 146 is in the second position.

At least one internal stop may be positioned within an inner surface of upper portion 140 of restrictive lid 120. The internal stops may be projections within the inner surface of restrictive lid 120 that are configured interface with at least one of the plurality of fans to limit, reduce, and/or stop flywheel 146 from rotating. In embodiments, the internal stops 148 may be configured to interface with at least one of the plurality of fans to stop the rotation of the flywheel 146 if the axis of rotation of flywheel 146 is in the upper, second position. In embodiments, if the axis of rotation of flywheel 146 is in the second position, an end of the first of the plurality of fans may be positioned adjacent to a first internal stop, such that the flywheel 146 may not be rotated in a first rotational direction. In one embodiment, if the axis of rotation is in the second position, an end of a second of the plurality of fans may be positioned adjacent to a second internal stop, such that the flywheel 146 may not be rotated in a second rotational direction, wherein the first and second rotational directions are different rotational directions.

Figure 2:
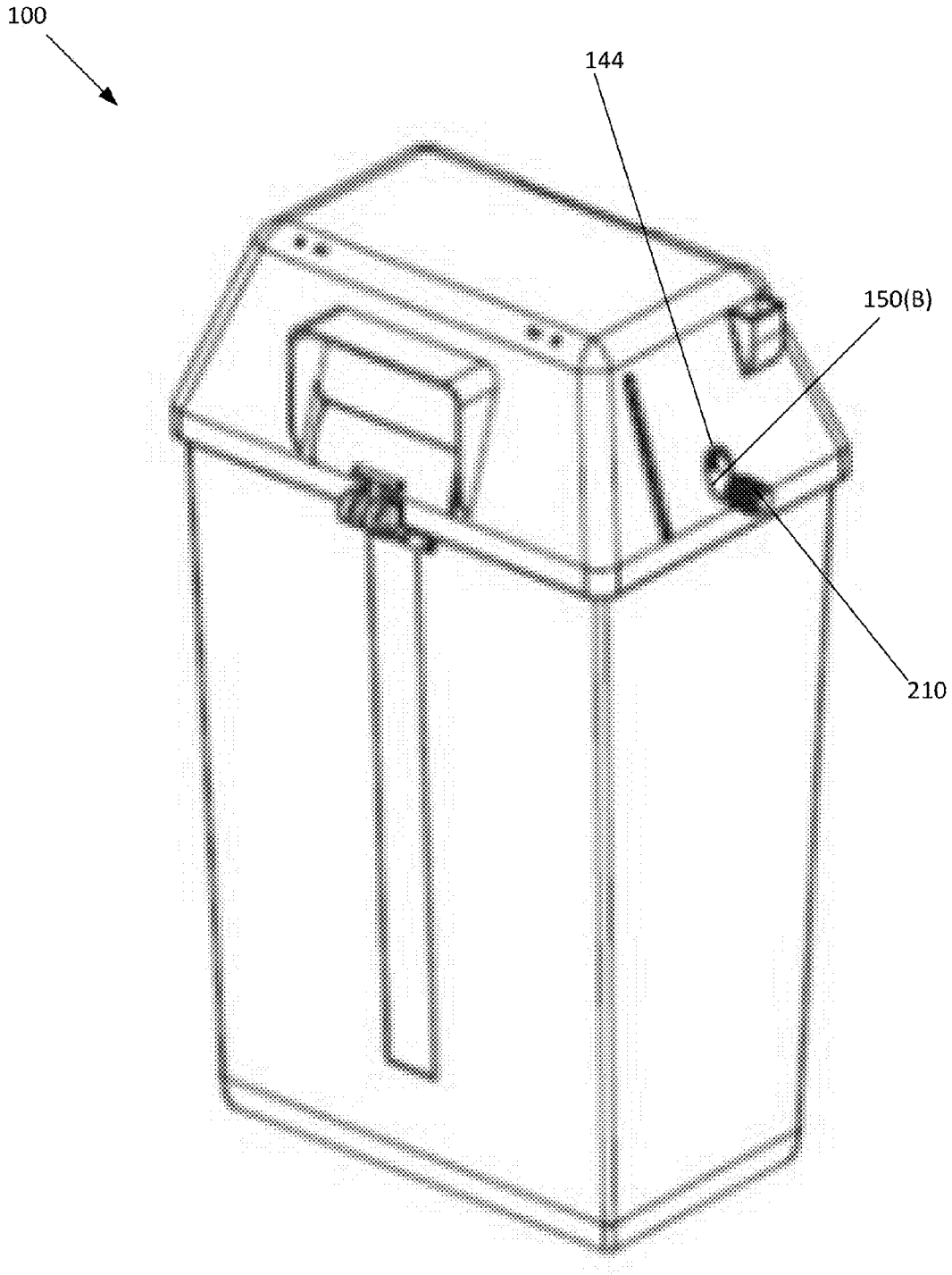
FIG. 2 depicts prospective view of a pharmaceutical waste system, according to an embodiment.

FIG. 2 depicts prospective view of pharmaceutical waste system 100, according to an embodiment. Elements depicted in FIG. 2 may be substantially the same as elements depicted in FIG. 1, therefore for the sake of brevity an additional description of these elements is omitted.

As depicted in FIG. 2, projection 150(B) may be configured to extend out of slot 144, and projection 150(B) may include grooves, notches, etc. (referred to hereinafter collectively and individually as "grooves 210"). A user may be to hold groves 210 to rotate the flywheel 146 positioned within restrictive lid 120. Accordingly, when pharmaceutical waste is disposed on a fan of flywheel 146, door 142 may be in the closed position while a user rotates flywheel 146. Therefore, the user does not have to interact with the pharmaceutical waste to rotate flywheel 146.

Figure 3:
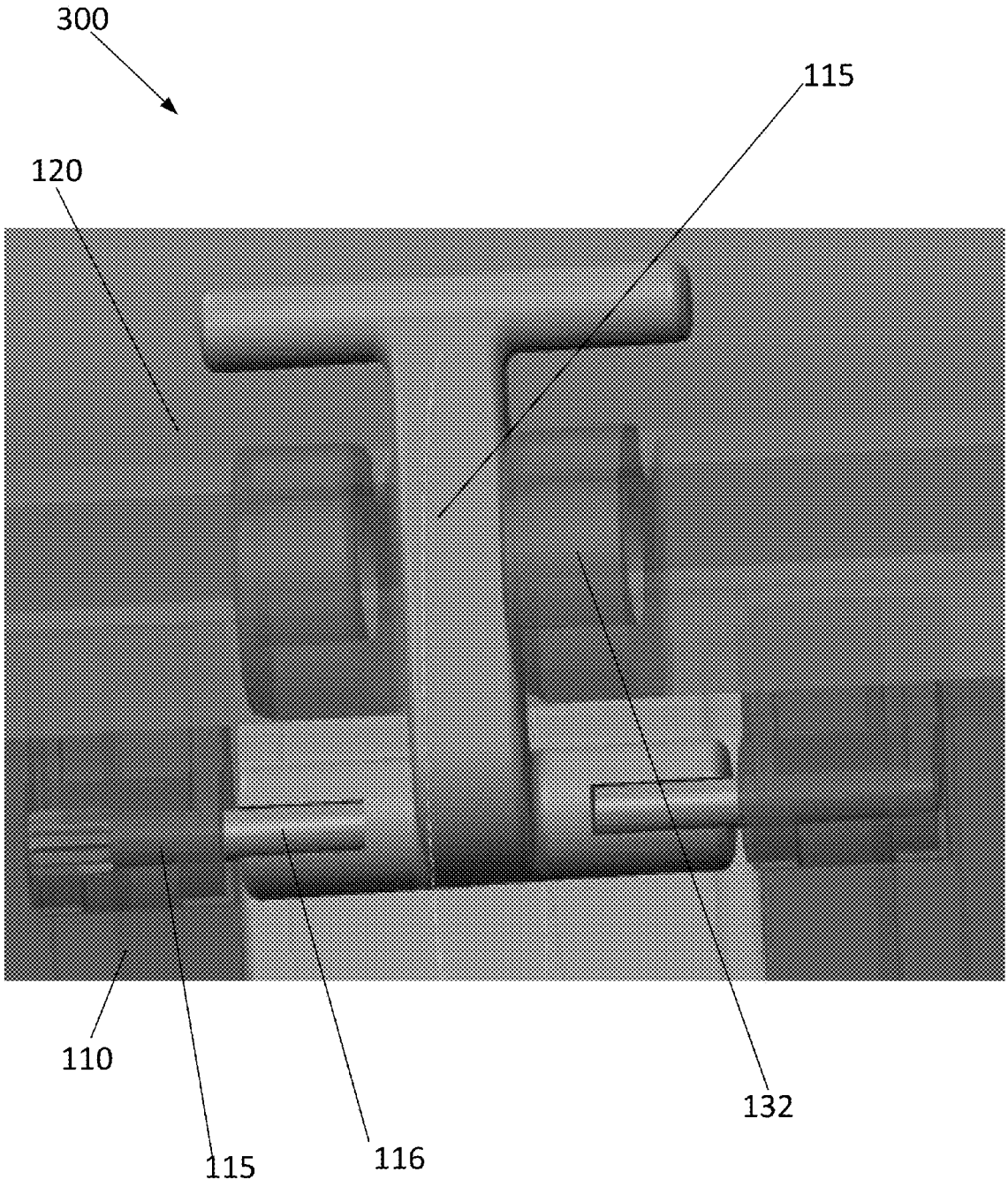
FIG. 3 depicts one embodiment of a locking latch being in a locked position, according to an embodiment.

FIG. 3 depicts one embodiment of locking latch 116 being in a locked position 300. Lock latch 116 may be a device configured to couple restrictive lid 120 and pharmaceutical waste container 110. In embodiments, locking pin 117 may be configured to be inserted through locking interface 115 and orifices within the first end of locking latch 116. A second end of locking latch 116 may be configured to be positioned above lock receiver 132. When locking latch 116 is positioned above lock receiver 132 and locking pin 117 is inserted through locking interface 115 and locking latch 116, then a lock may be positioned through lock receiver 132. Responsive to the lock being inserted through lock receiver 132, locking latch 116 may be securing in place to secure restrictive lid 120 and pharmaceutical waste container 110.

Figure 4:
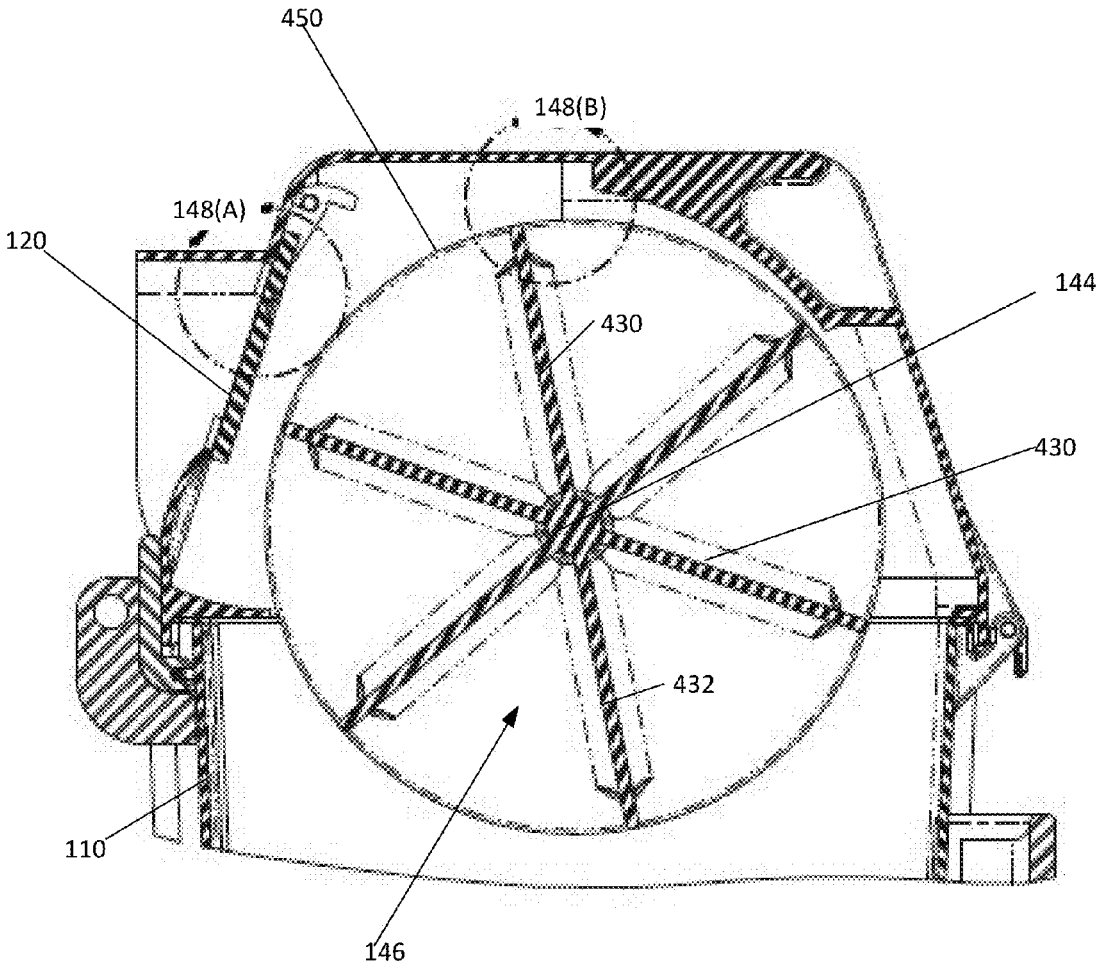
FIG. 4 depicts a side view of flywheel being an upper position within a slot, according to an embodiment.

FIG. 4 depicts side view of flywheel 146 being an upper position within slot 144, according to an embodiment. Elements depicted in FIG. 4 may be substantially the same as elements depicted in FIGS. 1-3, therefore for the sake of brevity an additional description of these elements is omitted.

As depicted in FIG. 4, slot 144 is configured to receive a projection of the flywheel, which may be positioned on an edge of flywheel 146. Slot 144 may have an inner perimeter that has a slightly larger diameter than that of the projection. Therefore, the projection may be rotated, turned, spun, etc. while being disposed within slot 144. Furthermore, slot 144 may have a height that is configured to allow the projection to move vertically while being positioned within slot 144. As the projection vertically moves within slot 144, the axis of rotation of flywheel 146 may correspondingly change. The projection may be vertically moved within slot 144 based on a level of pharmaceutical waste positioned within a reusable pharmaceutical waste container. Responsive to a first fan 432 (e.g. a bottom fan) of the plurality of fans 430 interacting with the pharmaceutical waste within the reusable pharmaceutical container 110, the first fan 432 of the plurality of fans 430 may push the projection upwards away from the pharmaceutical waste in the reusable pharmaceutical waste container.

In one embodiment, if the projection is positioned in a lower portion of slot 144, flywheel 146 may have a lower axis of rotation causing plurality of fans 430 to have a first circumference with a first axis of rotation. If the projection is positioned in an upper portion of slot 144, flywheel 146 may have an upper axis of rotation causing plurality of fans 430 to have a second circumference with a second axis of rotation. Accordingly, based on the amount of pharmaceutical waste within the reusable pharmaceutical waste container 110, the plurality of fans 430 may have a different axis of rotation, wherein a first axis of rotation and a second axis of rotation are vertically offset.

In embodiments, if the level of pharmaceutical waste within the pharmaceutical waste container 110 is above a pharmaceutical waste threshold, the first fan 432 of the plurality of fans 430 may interact with the pharmaceutical waste to push the projection from a lower position within slot 144 to an upper position with slot 144.

As depicted in FIG. 4, the projection is in the lower position within slot 144, and flywheel 146 may freely rotate within reusable pharmaceutical waste container 110 and restrictive lid 120. In embodiments, if the projection is in the lower position, the outer edge of the plurality of fans 430 may travel along the circumference of a first circle 450 within the reusable waste container 110 and may not touch the internal stops or an inner surface of the restrictive door. Whereas if the projection is in the upper position, the outer edges of the plurality of fans 430 may have their travel impeded by stops 148(A) and 148(B).

If the level of waste within the reusable pharmaceutical waste container 110 is above the waste threshold, the projection may be positioned in an upper position within slot 144. If the pharmaceutical waste is above the pharmaceutical waste threshold, then the fans 430 of flywheel 146 may move along the circumference of a second circle and be restricted from rotating by at least one of the plurality of stops 148(A) and 148(B). If fans 430 are restricted from rotating, then an end of at least one of the plurality of fans 430 may be positioned adjacent to at least one of the plurality of stops 148.

Figure 5:
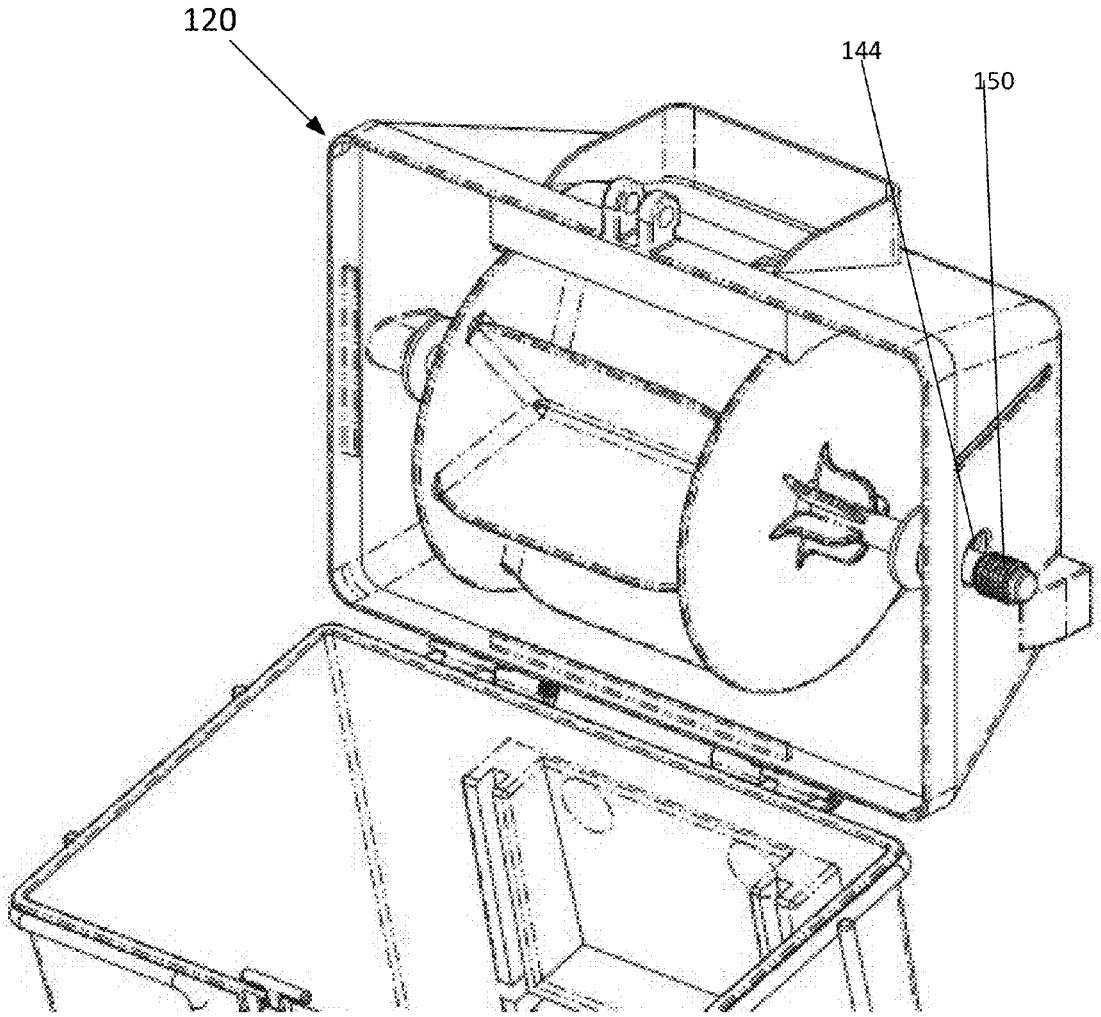
FIG. 5 depicts side view of a flywheel being a lower position within a slot, according to an embodiment.

FIG. 5 depicts an embodiment of lid 120. As depicted in FIG. 5, projection 150 may slide vertically within slot 144. Accordingly, projection 150 may move from an lower position within slot 144, wherein projection 150 is positioned in the lower half of slot 144, to an upper positioned within slot 144, wherein projection 150 is positioned in the upper half of slot 144.

Figure 6:
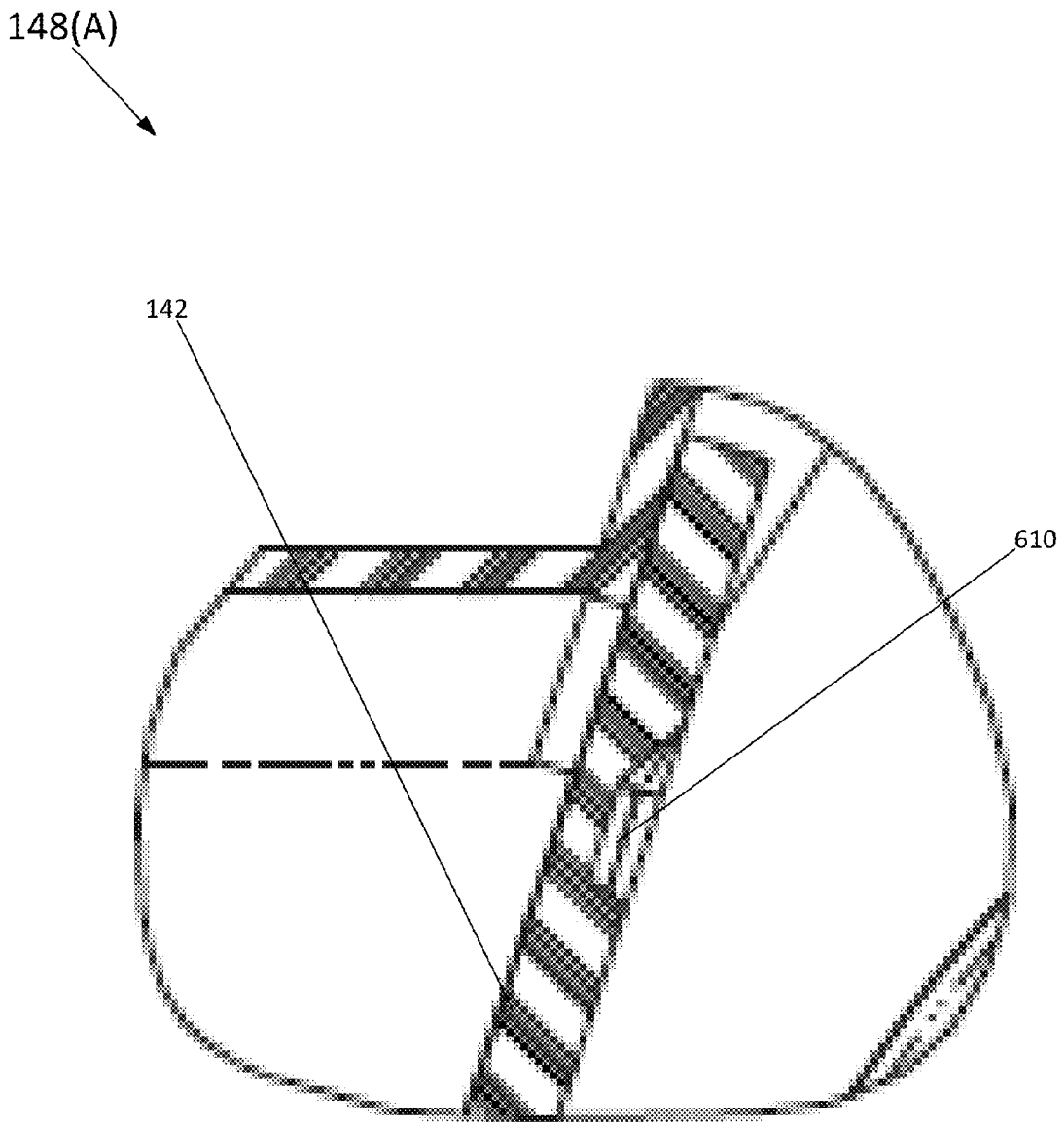
FIG. 6 depicts a projection of a flywheel is positioned in an upper position within a slot, according to an embodiment.

FIG. 6 depicts one embodiment of, restrictive door 142 includes a slot, groove, or indention (referred to herein after as "door lock 610") configured to secure one of the plurality of fans in place if the projection of flywheel 146 is positioned in an upper position within slot 144. Door lock 610 may be positioned on an inner surface of restrictive door 142. Door lock 610 may be an indentation within restrictive door 142 that is configured to interface with at least one fan of flywheel 146.

In embodiments, if a projection of flywheel 146 is positioned at a lower position within slot 144, then the plurality of fans may not contact door lock 610. Responsive to the projection of flywheel 146 being in an upper position within slot 144, a first fan of the plurality of fans may interface with door lock 610. If door lock 610 is interfaced with the first fan, then the sides of the first fan may be positioned adjacent to, and within door lock 610 to restrict, inhibit, and/or limit the rotation of flywheel 144 in either rotational direction. Furthermore, if door lock 610 is interfaced with the first fan, then restrictive door 142 may not rotate inward into the inner portion of restrictive lid 120. Therefore, door lock 610 may be configured to lock restrictive door 142 in the closed position if the projection of flywheel is in an upper position within the slot.

In embodiments, a first fan may receive for from door lock 610 in a direction towards the axis of rotation of flywheel 146, and the first fan may distribute force towards door lock 610 if a user is trying to open restrictive door 142. Responsive to the first fan receiving the force from door lock 610, the first fan may not rotate and apply force to door lock 610 such that restrictive door 142 may not be in the open position.

Figure 7:
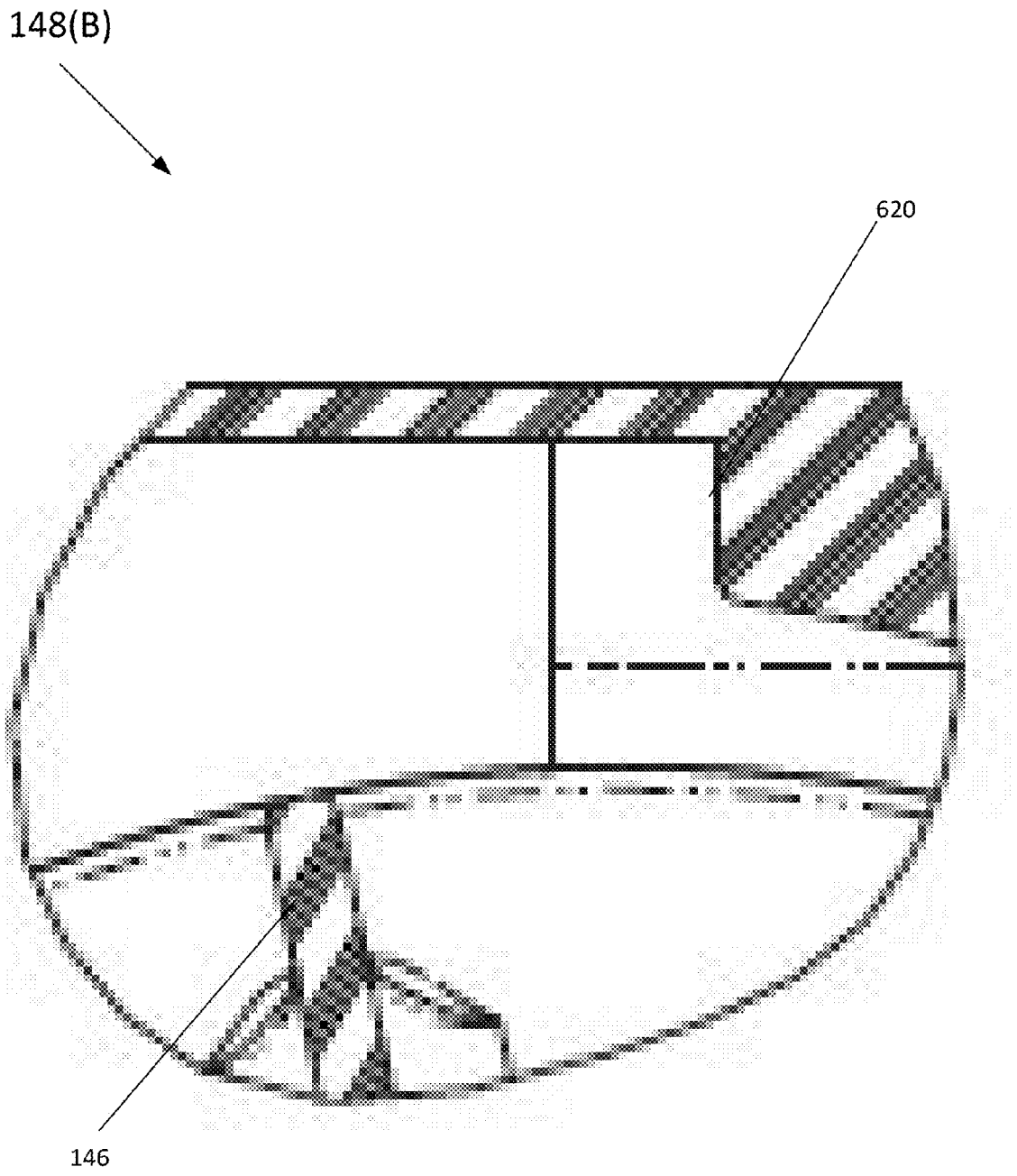
FIG. 7 depicts physical forces if a projection of a flywheel is positioned in an upper position within a slot, according to an embodiment

FIG. 7 depicts one embodiment of an internal stop 620 positioned on an inner surface of restrictive lid 120. The internal stop 620 may be projections extending from the surface of restrictive lid 120 towards slot 144. Internal stop 620 may be configured to interface with a second fan of the plurality of fans to restrict, inhibit, and/or limit the rotation of flywheel 146 in a clockwise direction. Therefore, if the projection of flywheel 146 is in an upper position within slot 144, then a first side of the second fan rotating in a clockwise direction may be positioned adjacent to internal stop 620.

In further embodiments, an internal surface of restrictive lid may include additional internal stops (not shown). The additional internal stops may be configured to interface with a third fan of the plurality of fans to restrict, inhibit, and/or limit the rotation of flywheel 146 in a counter clockwise direction. Therefore, if the projection of flywheel 146 is in an upper position within slot 144, then a second side of the second fan rotating in a counter-clockwise direction may be positioned adjacent to the additional internal stop.

In embodiments, the second fan may exert force against second internal stop 620 if flywheel 146 is being rotated in a clockwise direction. However, second internal stop 620 may apply force against the second fan such that flywheel 146 may not be rotated in a clockwise direction.

Accordingly, if the projection of flywheel 146 is in an upper position within slot 144, then door lock 610 and at least one internal stop 620 may interface with a plurality of fans of flywheel 146 to restrict, inhibit, and/or limit the rotation of flywheel 146 while not allowing restrictive door 142 from being opened.

Figure 8:
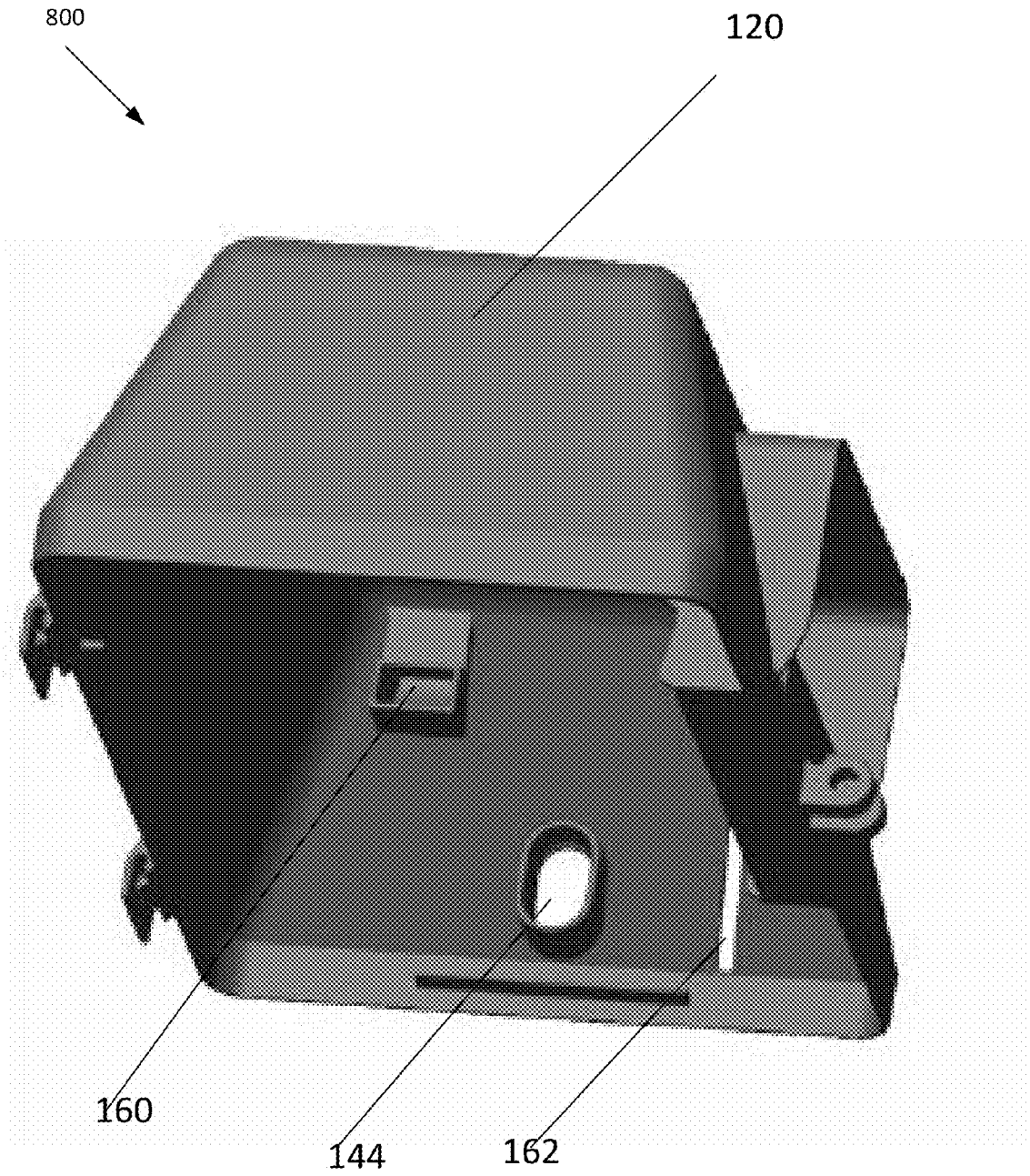
FIG. 8 depicts one embodiment of an inside view of a restrictive lid, according to an embodiment.

FIG. 8 depicts one embodiment of an inside view of restrictive lid 120. As depicted in FIG. 8, pill drop interface 160 and vertical orifice 162 have openings extending to the inner surface of restrictive lid 120. Accordingly, users may dispose of pharmaceutical waste through pill drop interface 160 and vertical orifice 162.

Figure 9:
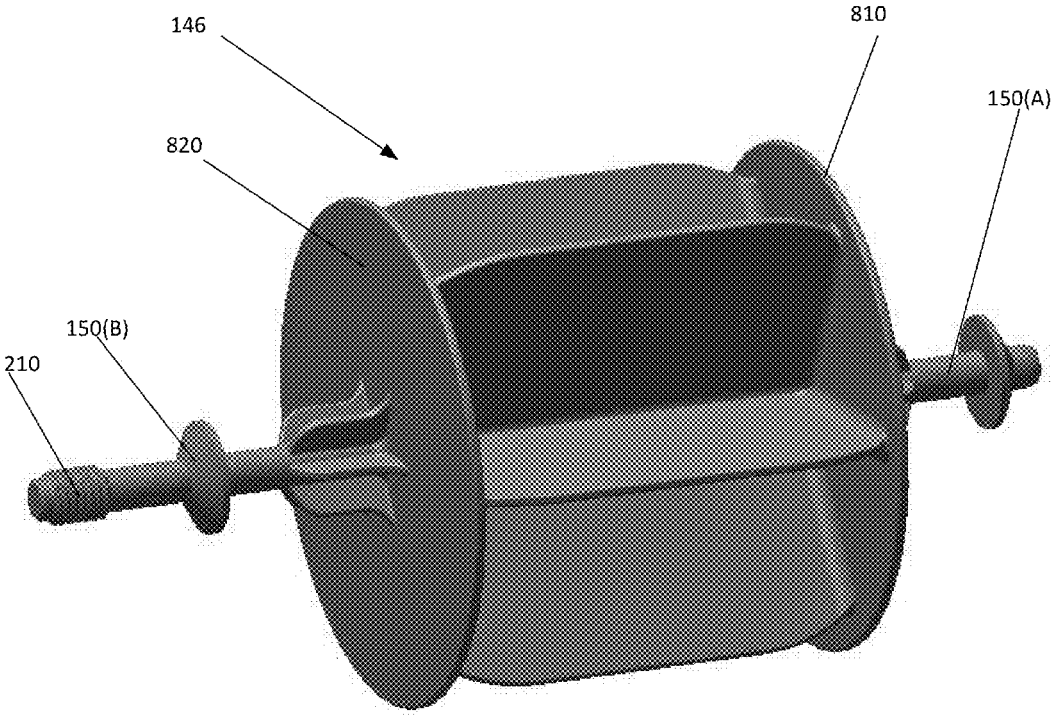
FIG. 9 depicts one embodiment of a flywheel, according to an embodiment.

FIG. 9 depicts one embodiment of flywheel 146. As depicted in FIG. 9, flywheel 146 may have a first projection 150(A) having a first length, and a second projection 150(B) having a second length. The first length of first projection 150(A) may have a distance such that first face 810 of flywheel is position adjacent a first side of restrictive lid. The second length of second projection 150(B) may have a distance such that there is space between a second side of restrictive lid and second face 820. Accordingly, pills and/or other pharmaceutical waste may be disposed of into pharmaceutical waste container 110 even if flywheel 146 is in the second position.

Figure 10:
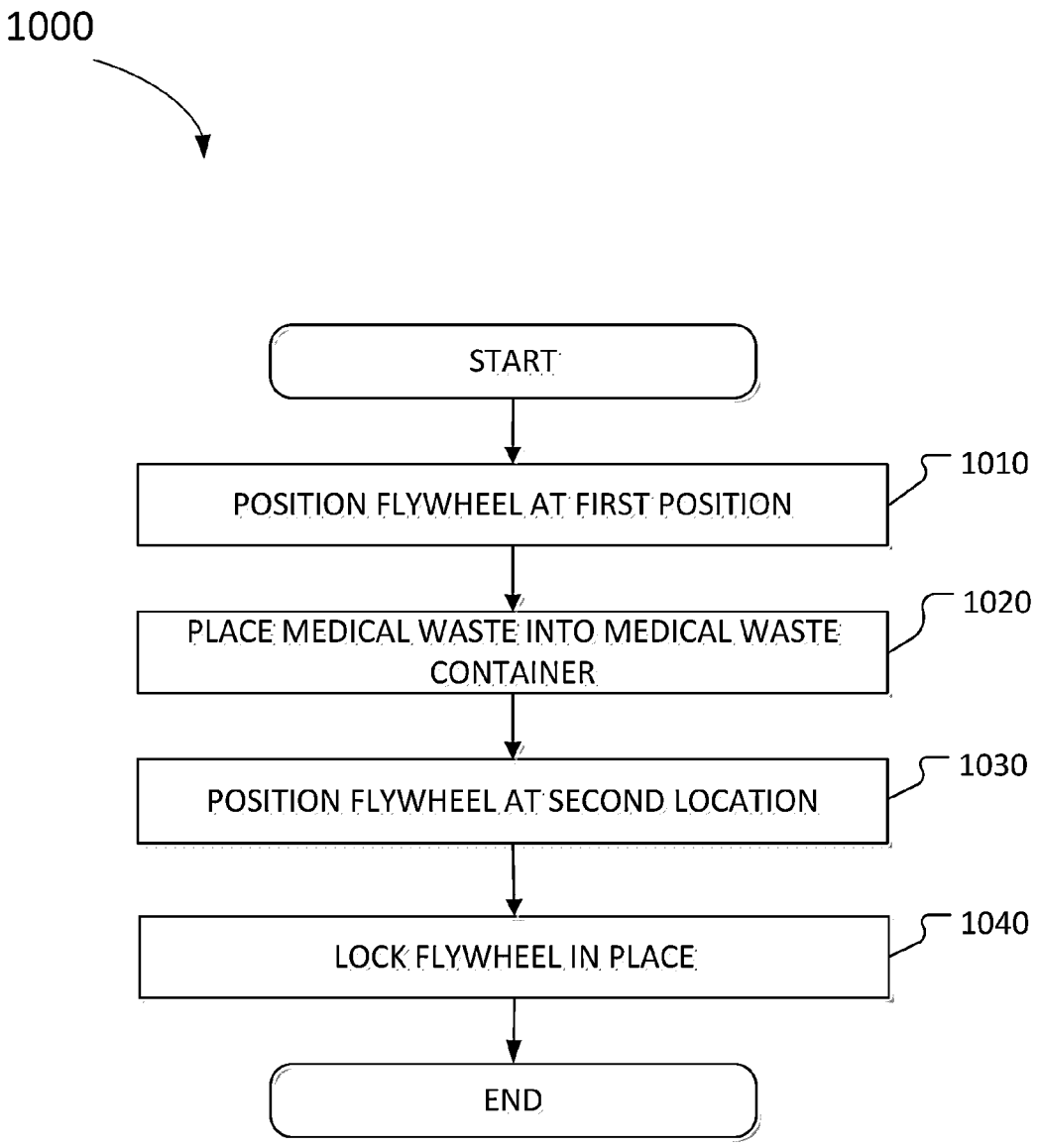
FIG. 10 depicts a method for disposing of pharmaceutical waste, according to an embodiment.

FIG. 10 depicts a method 1000 for disposing of pharmaceutical waste, according to an embodiment. The operations of method 1000 presented below are intended to be illustrative. In some embodiments, method 1000 may be accomplished with one or more additional operations not described, and/or without one or more of the operations discussed. Additionally, the order in which the operations of method 1000 are illustrated in FIG. 10 and described below is not intended to be limiting.

At operation 1010, a flywheel coupled to slots of a restrictive lid may be positioned at a first position. When the flywheel is positioned at the first position, the edges of fans of the flywheel may rotate along a first circumference.

At operation 1020, pharmaceutical waste may be disposed of within the pharmaceutical waste container. The pharmaceutical waste may be disposed of by placing the waste through a restrictive door, pill drop interface, vertical orifice, etc.

At operation 1030, the pharmaceutical waste within the pharmaceutical waste container may contract the flywheel, which may move the flywheel from the first position to a second position. When the flywheel is positioned at the second position, the edges of fans of the flywheel may rotate along a second circumference, wherein the second circumference is vertically offset from the first circumference.

At operation 1040, responsive to the axis of rotation of the flywheel being vertically changed to the second position, a first of the plurality of fans may interface with a projection positioned on a restrictive lid. Responsive to the first of the plurality of fans interfacing with the projection position on the restrictive lid the restrictive lid may not open internally within the restrictive lid. Accordingly, no pharmaceutical waste may be placed within the pharmaceutical waste container when the flywheel is in the second position.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present embodiments. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

The flowchart and block diagrams in the flow diagrams illustrate the architecture, functionality, and operation of possible implementations of systems, methods, and computer program products according to various embodiments of the present embodiments. In this regard, each block in the flowchart or block diagrams may represent a module, segment, or portion of code, which comprises one or more executable instructions for implementing the specified logical function(s). It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware.

As used herein, the terms "comprises," "comprising," "includes," "including," "has," "having," or any other variation thereof, are intended to cover a non-exclusive inclusion. For example, a process, article, or apparatus that comprises a list of elements is not necessarily limited to only those elements but may include other elements not expressly listed or inherent to such process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B is true (or present).

What is claimed is:

1. A system for a disposing pharmaceutical waste, the system comprising:

a pharmaceutical waste container configured to receive the pharmaceutical waste;

a lid configured to be disposed over the pharmaceutical waste container;

a restrictive door positioned on the lid, the restrictive door being configured to rotate inward into the lid to form an opening within the lid, wherein responsive to the restrictive door opening inward the pharmaceutical waste can be inserted into the lid, a first slot positioned on a first side of the lid;

a second slot positioned on a second side of the lid;

a flywheel configured to complete a full rotation within the lid, the flywheel including a first projection being configured to extend through the first slot and a second projection being configured to extend through the second slot, the flywheel being configured to be rotated responsive to the pharmaceutical waste being inserted through the lid, the flywheel including a plurality of fans, and an end of each of the plurality of fans is configured to be positioned adjacent to inner sidewall of the restrictive door when the restrictive door is not rotated inward; and a pill drop interface positioned on the first side of the lid, the pill drop interface being configured to receive pills inserted into the pill drop interface;

a vertical orifice positioned on the first side of the lid, the vertical orifice being configured to receive patches inserted into the vertical orifice.

2. A system for a disposing pharmaceutical waste, the system comprising:

a pharmaceutical waste container configured to receive the pharmaceutical waste;

a lid configured to be disposed over the pharmaceutical waste container;

a restrictive door positioned on the lid, the restrictive door being configured to rotate inward, wherein responsive to the restrictive door opening inward the pharmaceutical waste can be inserted into the lid;

a first slot positioned on a first side of the lid;

a second slot positioned on a second side of the lid;

a flywheel with a first projection being configured to extend through the first slot and a second projection being configured to extend through the second slot, the flywheel being configured to be rotated responsive to the pharmaceutical waste being inserted into the lid; and a pill drop interface positioned on the first side of the lid, the pill drop interface being configured to receive pills inserted into the pill drop interface;

a vertical orifice positioned on the first side of the lid, the vertical orifice being configured to receive patches inserted into the vertical orifice.

3. The system of claim 1, further comprising:

a latch interface positioned on the pharmaceutical waste container;

a lock receiver positioned on the lid, the lock receiver including a plurality of orifices being configured to receive a lock;

a locking latch including a first end, a second end and a shaft, the first end configured to align with the latch interface, the second end being configured to be positioned above the lock receiver, the shaft being configured to couple the first end and the second end;

a locking pin being configured to be inserted through the first end of the latch and the latch interface, wherein responsive to the lock being inserted into the lock receiver the locking latch is positioned adjacent to the pharmaceutical waste container and the lid.

4. The system of claim 1, wherein the first projection and the second projection on the flywheel are configured to vertically move from a first position to a second position via the first slot and the second slot, wherein the first slot and the second slot are stationary.

5. The system of claim 4, wherein the first projection and the second projection are configured to move from the first position to the second position responsive to a level of pharmaceutical waste with the pharmaceutical waste container being above a waste threshold.

6. The system of claim 4, wherein when the first projection and the second projection are in the first position the flywheel has a first axis of rotation, and when the first projection and the second projection are in the second position the flywheel has a second axis of rotation, the first axis of rotation being below the second axis of rotation and the first axis of rotation being only vertically offset from the second axis of rotation.

7. The system of claim 6, wherein the restrictive door includes a locking mechanism disposed on the inner surface of the lid, the locking mechanism including a first protrusion, wherein the first protrusion is configured to be positioned adjacent to a first fan of the flywheel when the first projection and the second projection are in the second position.

8. The system of claim 7, wherein when the first protrusion is positioned adjacent to the first fan of the flywheel the flywheel is not able to rotate in a first direction and the restrictive door is not able to internally open.

9. The system of claim 8, wherein the lid includes a second protrusion, wherein the second protrusion is configured to be positioned adjacent to a second fan of the flywheel when the first projection and the second projection are in the second position.

10. The system of claim 8, wherein when the second protrusion is positioned adjacent to the second fan of the flywheel the flywheel is not able to rotate in a second direction, the second direction and the first direction being opposite directions.

11. A method for a disposing pharmaceutical waste, the method comprising:

placing a lid over a pharmaceutical waste container;

inserting the pharmaceutical waste through the lid by inwardly rotating a restrictive door into the lid rotate inward into the lid to form an opening within the lid, wherein the restrictive lid is positioned on the lid, positioning a first projection and a second projection of a flywheel through a first slot and a second slot on the lid, wherein the first slot is positioned on a first side of the lid and the second slot is positioned on a second side of the lid, the flywheel being configured to complete a full rotation within the lid and including a plurality of fans, and an end of each of the plurality of fans is configured to be positioned adjacent to an inner sidewall of the restrictive door when the restrictive door is not inwardly rotated;

rotating the flywheel responsive to the pharmaceutical waste being inserted into the lid;

inserting a pill into a pill drop interface positioned on the first side of the lid; and inserting a patch into a vertical orifice positioned on the first side of the lid.

12. The method of claim 11, further comprising:

aligning a first end of a locking latch with a latch interface;

inserting a locking pin through the first end of the locking latch and the latch interface;

positioning a second end of the locking latch over a lock receiver;

positioning a lock through the lock receiver;

positioning a stem of the locking latch adjacent to the lid and the pharmaceutical waste container responsive to positioning the lock through the lock receiver.

13. The method of claim 11, further comprising:

vertically moving, via the first slot and the second slot, wherein the first slot and the second slot are stationary, the first projection and the second projection from a first position to a second position.

14. The method of claim 13, wherein the first projection and the second projection are configured to move from the first position to the second position responsive to a level of pharmaceutical waste with the pharmaceutical waste container being above a waste threshold.

15. The method of claim 13, further comprising:

changing the axis of rotation from a first axis of rotation to a second axis of rotation responsive to vertically moving the first projection and the second projection from the first position to the second position rotation, and the first axis of rotation being only vertically offset from the second axis of rotation.

16. The method of claim 15, further comprising:

positioning a first fan of the flywheel adjacent to a first protrusion disposed on the inner surface of the lid when the first projection and the second projection are in the second position.

17. The method of claim 16, further comprising:

restricting the rotation of the flywheel when the first protrusion is positioned adjacent to the first fan of the flywheel; and restricting the movement of the restrictive door when the first protrusion is positioned adjacent to the first fan of the flywheel.

18. The method of claim 17, further comprising:

positioning a second fan of the flywheel adjacent to a second protrusion positioned on an inner surface of the lid when the first projection and the second projection are in the second position.

19. The method of claim 18, wherein when the second protrusion is positioned adjacent to the second fan of the flywheel the flywheel is not able to rotate in a second direction, the second direction and the first direction being opposite directions.

* * * * *